US008601768B2

(12) United States Patent
Cashman

(10) Patent No.: US 8,601,768 B2
(45) Date of Patent: Dec. 10, 2013

(54) BUILDING TRIM

(71) Applicant: Daniel J. Cashman, Suffield, CT (US)

(72) Inventor: Daniel J. Cashman, Suffield, CT (US)

(73) Assignee: Trim Solutions, LLC, East Windsor, CT (US)

( * ) Notice: Subject to any disclaimer, the term of this patent is extended or adjusted under 35 U.S.C. 154(b) by 0 days.

(21) Appl. No.: 13/735,452

(22) Filed: Jan. 7, 2013

(65) Prior Publication Data

US 2013/0118111 A1 May 16, 2013

Related U.S. Application Data

(60) Division of application No. 12/928,994, filed on Dec. 22, 2010, now Pat. No. 8,347,583, which is a continuation-in-part of application No. 12/152,112, filed on May 12, 2008, now Pat. No. 7,874,108, and a continuation of application No. 12/383,976, filed on Mar. 31, 2009, now Pat. No. 8,141,308.

(51) Int. Cl.

| | |
|---|---|
| ***E04B 1/00*** | (2006.01) |
| ***E06B 1/00*** | (2006.01) |
| ***E06B 3/00*** | (2006.01) |

(52) U.S. Cl.

USPC ..... 52/718.01; 52/213; 52/204.1; 52/204.54; 52/581; 52/717.01; 52/519

(58) Field of Classification Search

USPC ..... 52/716.8, 718.01, 718.04, 287.1, 716.1, 52/717.05, 717.06, 210, 717.01, 204.54, 52/588.1, 204.1, 204.53, 94–96, 198, 52/288.1, 204.55, 204.56, 745.16, 52/208–213, 204.5, 745.15

See application file for complete search history.

(56) References Cited

U.S. PATENT DOCUMENTS

| | | | | |
|---|---|---|---|---|
| 3,038,571 | A * | 6/1962 | Clements | 52/464 |
| 4,608,800 | A * | 9/1986 | Fredette | 52/656.1 |
| 5,711,117 | A * | 1/1998 | Zaccagni et al. | 52/94 |
| 7,669,382 | B2 * | 3/2010 | Burton et al. | 52/745.16 |
| 8,006,445 | B2 * | 8/2011 | Burton et al. | 52/204.55 |

* cited by examiner

*Primary Examiner* — Jeanette E. Chapman

(74) *Attorney, Agent, or Firm* — Alix, Yale & Ristas, LLP

(57) ABSTRACT

A trim element such as a door pilaster or frieze board, for attachment to a building wall, having front and back longitudinal faces, first and second longitudinal edges, and a longitudinal groove in the first edge. A mounting bracket for the wall has a forward strip that extends laterally and is selectively friction fit into the groove, a back strip that extends laterally on the back face of the element, and a connecting web between the forward and back strip that is flush with the first edge when the forward strip is fully inserted in the groove. A mounting flange for the wall extends laterally from the back face of the element, beyond the second longitudinal edge, and has a longitudinal channel along the second edge with a width that is effective to receive an edge of wall siding.

11 Claims, 8 Drawing Sheets

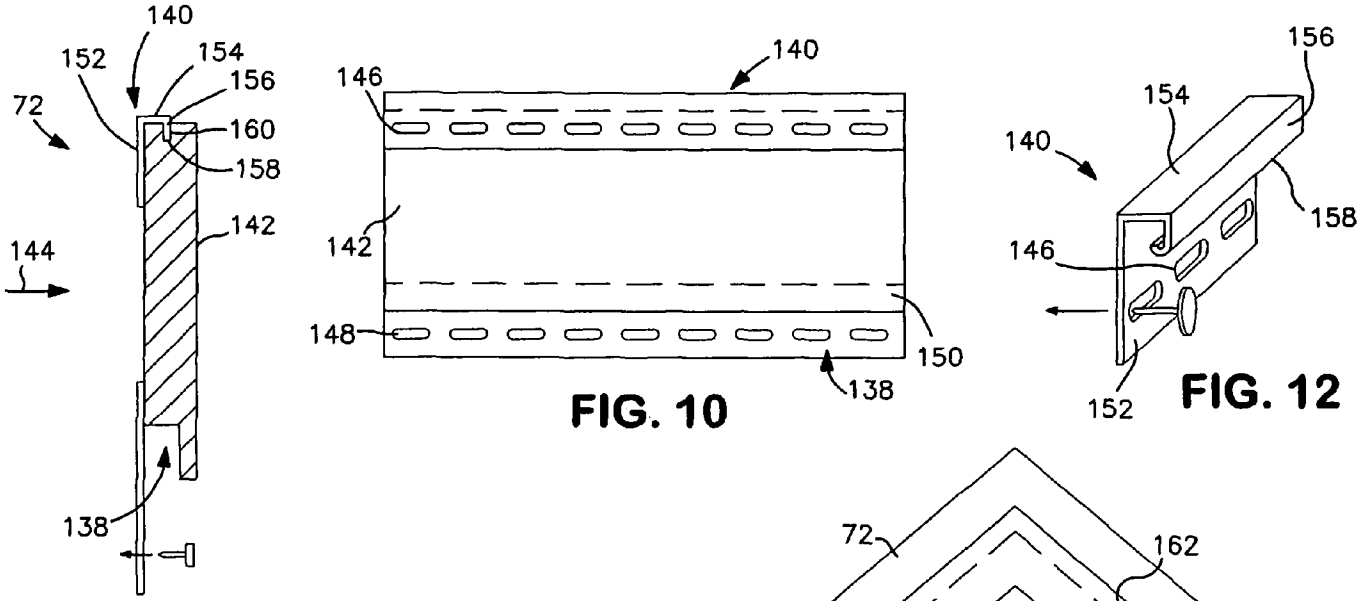
FIG. 12
FIG. 10
FIG. 9
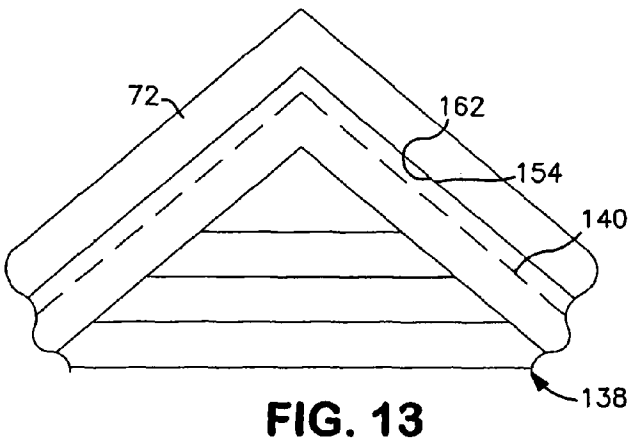
FIG. 13
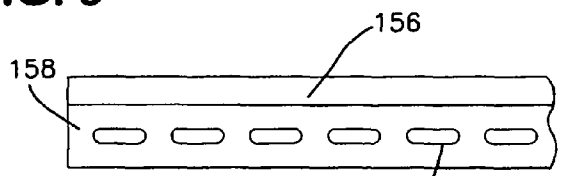
FIG. 11

BUILDING TRIM

RELATED APPLICATIONS

This application is a continuation-in-part of U.S. application Ser. No. 12/152,112, filed May 12, 2008 for "Window Frame With Installation Flange" and claims benefit under 35 U.S.C. §120 of U.S. application Ser. No. 12/383,976 filed Mar. 21, 2009 for "Prefabricated Corner Post".

BACKGROUND

The present invention relates to building construction and in particular to the framing of doors, windows, and other wall penetration, as well as to door mantles, door pilasters, frieze boards, and corner posts, all of which can be considered building trim.

Many residential and some commercial buildings have a clapboard type siding of wood, aluminum, or vinyl, which during construction or renovation must be trimmed to accommodate a wall penetration where a window box or the like is mounted, or otherwise must abut another type of building trim.

In one example a frame is secured to the wall and surrounds a window box, to provide both a visual enhancement to the window as well as an interface for a clean transition with the siding that surrounds the wall penetration. In another example, a mantle is secured to a wall portion above a door and two pilasters are secured to the wall on either side of the door. An oblique frieze board is often attached to a wall immediately below and following the angle of a roof overhang, with or without a horizontal frieze board spanning a wall between the bottom edges of the roof overhangs. Other frieze boards can be provided at or immediately above the building foundation. Corner posts are usually provided to cover the junction of two walls. Whether such trim is fabricated from wood or plastic, conventional installation includes driving nails or screws through the trim into the wall.

SUMMARY

An object of the present invention is to provide a window frame and other building trim which can be attached to the wall, before siding or the like is secured to the wall, in a manner that does not require driving attachment hardware through the front face of the trim.

In one aspect, the invention is directed to a window frame comprising a frame body defining a closed perimeter, the body having front and back faces and inner and outer edges with the outer edges defining a frame perimeter. A channel extends along the outer edge of the frame body and mounting strips are located in the channel, thereby providing a mounting flange around the perimeter of the frame. Once the frame is mounted to wall through the flange, siding is aligned with the outer edges of the frame and attached to the wall, covering and thus hiding the flange.

Whether intended for use with wood or other siding, the frame has the channel for the flange located closer to the back face, with a thickness less than the thickness of the siding.

For use with vinyl siding, primary and secondary channels are provided around the periphery of the frame, whereby the side edges of siding elements can be slid laterally into the primary channel and strips of plastic or the like can be secured within the secondary channels. The strips form the flange which is securable to the wall, and thereafter the siding elements can be inserted into the primary channels to finish the installation. Thus, in the preferred embodiment, the elements are plastic, the mounting strips are substantially flat plastic and the siding panels are plastic.

In this aspect, the invention is directed to a window frame comprising top, bottom and opposed side frame elements connected together to define a rectangular frame, each element having front and back faces and inner and outer edges whereby the outer edges define the frame perimeter. A primary channel extends along the outer edges of at least the side elements, and a secondary channel extends along the outer edges of at least the side elements, respectively between the primary channel and the back face.

In a related aspect, the window frame further includes a mounting strip having an inner edge extending through the secondary channel of each element and an outer edge outside the perimeter of the frame, thereby forming a flange, preferably with holes for receiving mounting nails or the like.

In yet another aspect, the invention is directed to a method of affixing a window frame around a window penetration or box in a flat wall before siding panels are affixed to the wall. The method comprises selecting a frame of the type having a channel for the mounting strips. The frame could have the strips already secured therein forming the mounting flange around the periphery of the frame, or the installer would insert the strips into the channel to form the flange. The frame with flange is placed around the window box with the back face of the frame against the wall. The flange is then affixed to the wall. Wood siding elements are cut to fit tight against the edge of the frame. For other than wood siding, the frame has another, wider channel toward the front such that a first siding panel is placed against the wall and a vertical edge is inserted into the front channel of the frame. Subsequent siding panels are similarly slid along the wall into the larger channel.

It is evident from the Background that the term "window" applies to a variety of building penetrations. Thus, a partially or totally prefabricated frame can be secured to the wall surrounding a wall penetration without attaching or driving any hardware into or on the frame itself.

The mounting strip or flange and associated channel for receiving the edge of a siding panel can be provided along opposed edges of other trim not associated with a wall penetration, such as corner posts and horizontal frieze boards spanning a wall between the bottom edges of roof overhangs. Both vertical outer edges of a corner post or the top and bottom horizontal edges of such frieze are fitted with the mounting strip and siding channel.

When embodied in door mantles, door pilasters, and roof line or foundation line friezes, the trim has one edge with mounting strip and siding channel, and another edge with a hidden mounting bracket. When installed, the trim unit comprises a body having front and back longitudinal faces and first and second longitudinal edges; a mounting bracket attached to the wall behind the back face of the body and secured to the trim body other than at the front face; a mounting flange extending laterally from the body beyond the second edge and attached to the wall; a channel along the second edge; and at least one wall siding panel covering the mounting flange, wherein each panel has an edge within the channel.

Preferably, the trim unit standing alone comprises a trim body having front and back longitudinal faces and first and second longitudinal edges; a longitudinal groove or channel in the first edge; a mounting bracket having a forward strip that is selectively friction fit into and out of the first groove, a back strip on the back face of the element, and a connecting web between the forward and back strips, that is preferably flush with the first edge when the forward strip is fully inserted in the groove. A mounting flange attached to the body extends laterally beyond the second longitudinal edge. A longitudinal channel along the second edge has a width that is effective to receive an edge of wall siding. The installer attaches the bracket to the wall through the back strip, and then press fits the front strip into the groove on the edge of the trim piece, before installing the siding panels into the channel.

From another aspect, the invention is directed to a method for installing a wall trim piece having a front face, a back face and opposite edges, comprising the steps of affixing a back portion of a bracket to a wall; manually inserting a front portion of the bracket into one edge of the trim piece whereby the trim piece is retained on the wall by the bracket; affixing the other edge of the trim piece to the wall with a mounting strip; and inserting an edge of at least one wall siding panel into a channel on the second edge, in front of the mounting strip.

BRIEF DESCRIPTION OF THE DRAWING

FIG. 9 is a schematic top view of a trim piece such as a door pilaster, door mantle or frieze board, that has a mounting strip and siding channel at one edge and a hidden starter bracket at the other edge;

FIG. 10 is a schematic view of the back of the trim piece of FIG. 9;

FIG. 11 is a schematic front view of the starter bracket of FIGS. 9 and 10;

FIG. 12 is a schematic oblique end view of the starter bracket of FIG. 11;

FIG. 13 is a front view of the roof gable depicted in FIG. 4, with a frieze board of the type shown in FIG. 9 obliquely mounted immediately below the roof line;

DETAILED DESCRIPTION

Figure 1:
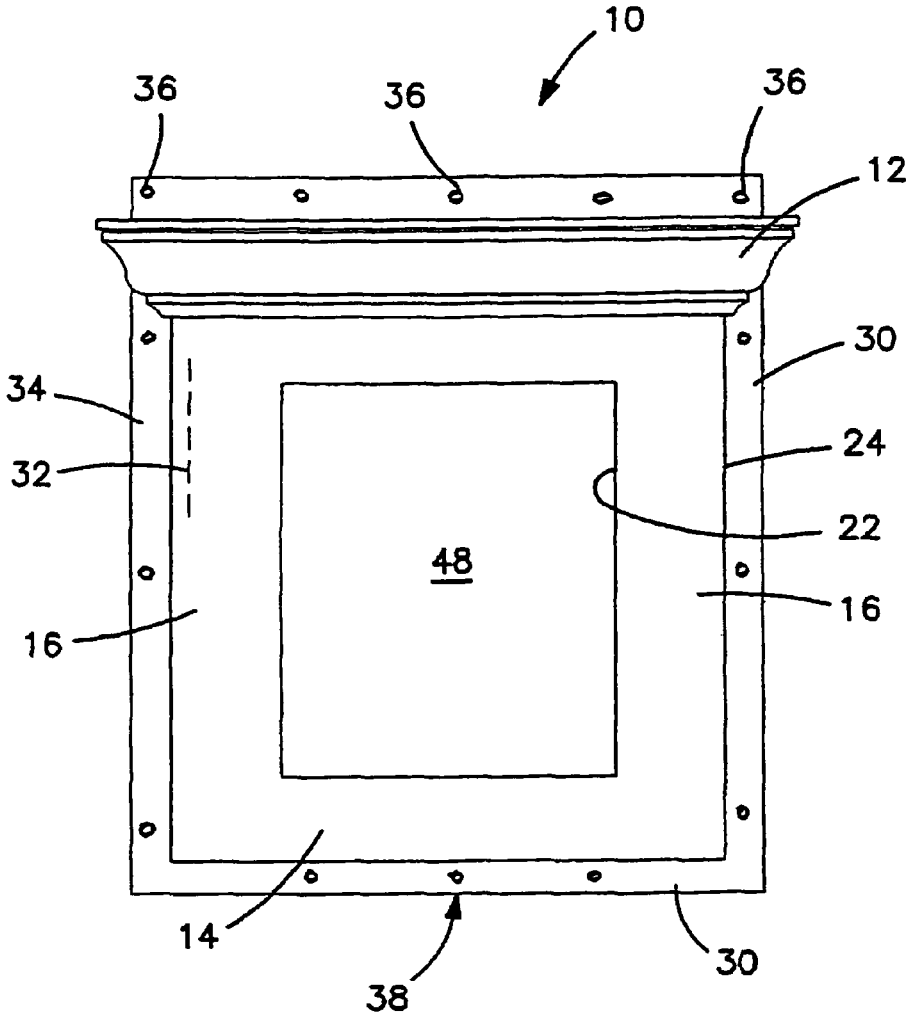
FIG. 1 is a front view of a window frame placed over a wall penetration prior to attachment of the frame to the wall.
Figure 2:
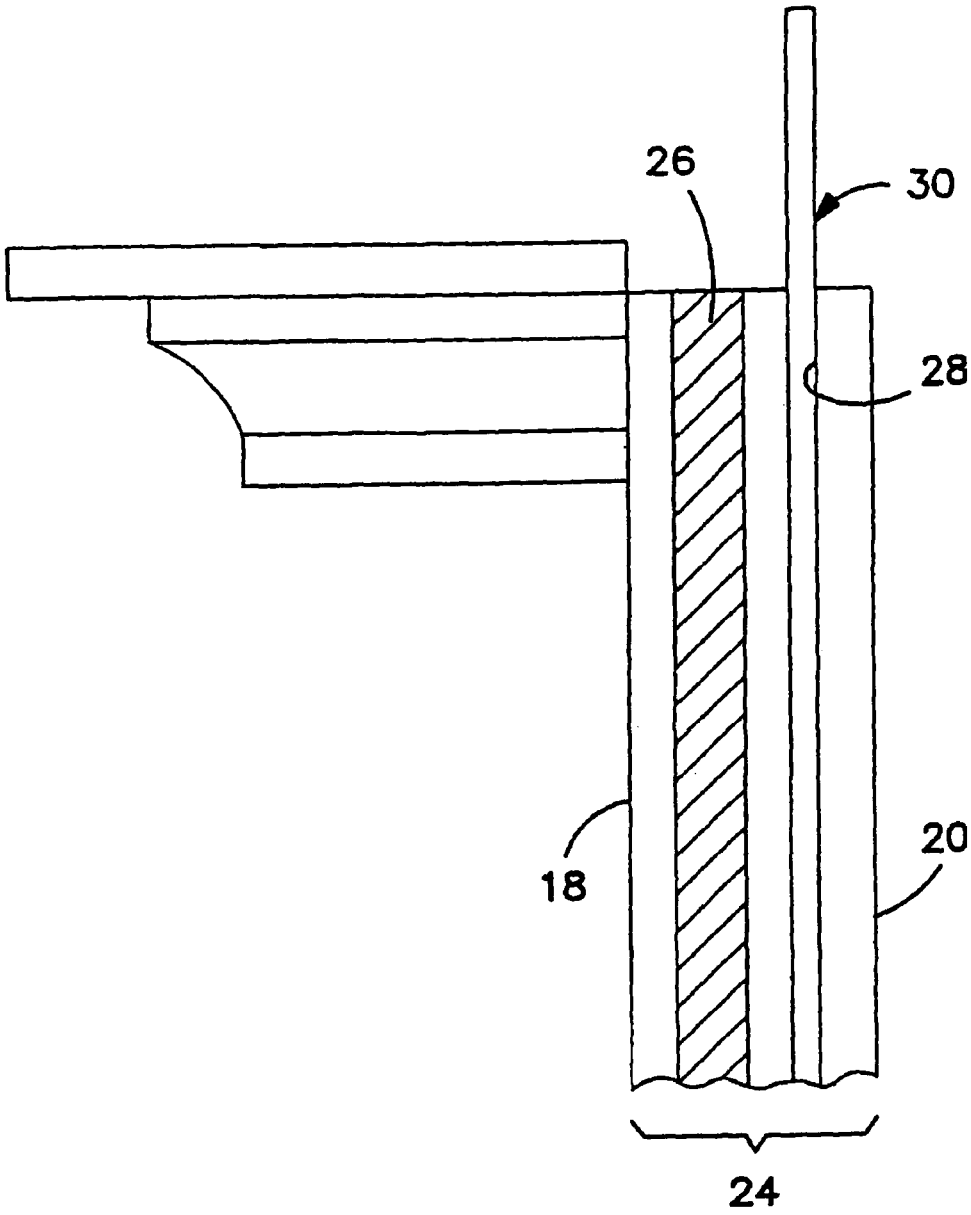
FIG. 2 is a side elevation view of the upper portion of the window frame of FIG. 1 showing the primary channel for receiving the edges of siding panels and a elongated strip in a secondary channel, forming a portion of the mounting flange for the frame.

FIGS. 1 and 2 show a prefabricated window frame 10 especially adapted for use with vinyl wall siding, having a top element 12, a bottom element 14, and side elements 16 connected together to define a rectangular frame, each element having front 18 and back 20 faces, and inner 22 and outer 24 edges, whereby the outer edges define the frame perimeter. At least the side elements 16, 18, and preferably all the elements have a primary channel 26 extending along the outer edge, and a secondary channel 28 extending along the outer edge between the primary channel 26 and the back face 20. The primary channel is situated closer to the front face 18, than to the secondary channel 28, either partially or entirely.

In the fully prefabricated embodiment shown in FIG. 1, a mounting strip 30 having an inner edge 32 (shown in phantom) extends through the secondary channel of each element, and an outer edge 34 outside the perimeter of the frame. Each mounting strip preferably includes a plurality of holes 36 for receiving mounting hardware such as nails or screws driven into the wall surrounding the wall penetration to be outlined by the wall penetration or window box to be surrounded by the frame. Preferably, the mounting strips are plastic and have a thickness which requires some degree of compression when slid into the secondary channels, producing an interference fit. Alternatively, mounting brackets or similar structures (not shown) can be located in the channels for positive engagement of the strips. In the preferred embodiment shown in FIG. 1, the strips form a flange surrounding the window box or penetration in the wall.

Preferably, the primary channel 26 is wider than the secondary channel 28, because the thickness of the flange 30 is typically about 1/16 inch, whereas the butt end of the siding elements or panels to be received in the primary channel 26, is wider and needs to be accommodated in a channel that is about 3/4 inch. The primary channel should be slightly wider than the butt of vinyl siding to allow for expansion. If used for wood siding, the primary channel can be eliminated, because the wood siding would typically be cut tight and caulked. The strip mounting channel would be less than about 1/8 inch in width, closer to the back face of the frame.

Figure 3:
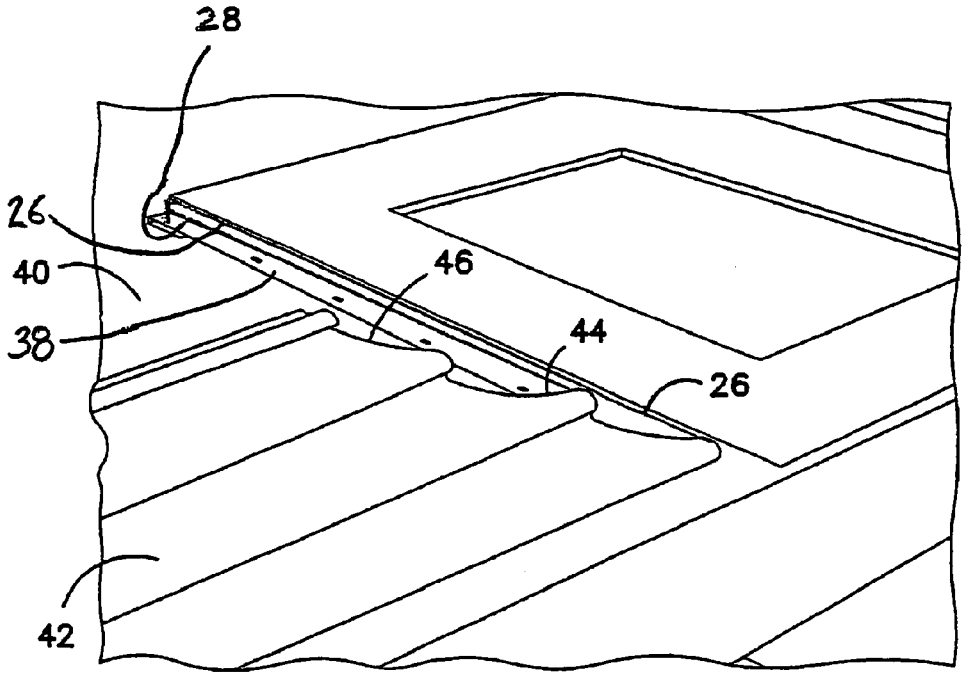
FIG. 3 is an oblique view of the frame with flange during the process of inserting the end edges of the siding panels into the primary channel of one side element of the frame.

With reference also the FIG. 3, the method of installation for use with vinyl siding will be described in greater detail. The frame can either be prefabricated with the flange as shown in FIG. 1, or the frame can be shipped to the installation site with the strips as separate components. Whether prefabricated as an entire unit, or assembled on site as such unit, the frame with strips and/or complete flange 38 are placed around the window box or similar penetration with the back face 20 of the frame against the wall 40. The flange is then affixed to the wall, such as by nailing through holes 36 to arrive at the condition shown in FIG. 1. To accommodate the subsequent attachment of the siding 42 to the wall 40, the longitudinal and seams 44 and end edges 46 of the panels are slid into the primary channel 26 of each frame element.

Thus, after the frame has been affixed to the wall, a first panel is placed against the wall and inserted with either a longitudinal edge at the seam 44, or an end edge 46, into a primary channel. Typically, the first side panel would be at the bottom 14 of the frame with a longitudinal seam inserted within the longitudinal channel associated with the bottom element. Subsequent panel elements would be connected to each other in vertical sequence and likewise the end seams and edges including ends of the seams would be inserted into the primary channel of the side element 16 of the frame. This process would continue with subsequent end edges 44 or 46 until the top 12 of the frame is reached, where upon another longitudinal seam 44 may or may not be inserted into the corresponding primary channel in the top element, depending on the spacing of the seams and the size and location of the frame relative to the initial panel inserted in the bottom element 14.

The invention is also usable with wood siding, but as discussed above, only one channel, for the flange strips, is required.

Figure 4:
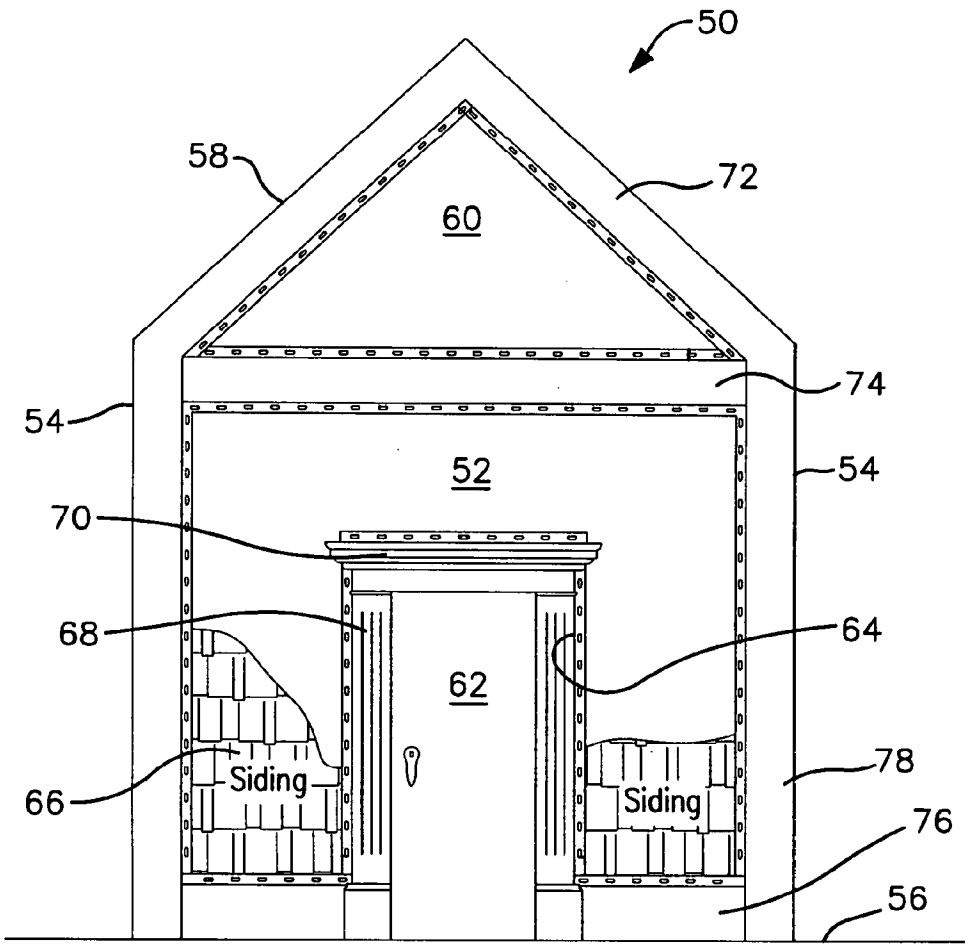
FIG. 4 is schematic representation of a residential building having a variety of trim including door mantle, door pilaster, corner posts, and three types of frieze boards.

FIG. 4 is a schematic representation of the front of a residence 50 to which reference will be made in describing a variety of other innovative trim pieces. The front 52 of the residence is shown, between sidewalls 54 which extend downwardly to the ground or foundation 56 and extend upwardly where the angled roof 58 presents a gable or the like 60. A main door 62 is provided at a front wall penetration 64 and siding, such as vinyl siding panels, are attached to the front wall and interlocked in a manner well known in building construction. Often, the door 62 is trimmed with opposed pilasters 68 having an inner edge which is substantially flush with the door penetration 64. Also, a door mantle or moulding 70 spans the pilasters above the door 62. Whereas these are highly decorative, other less decorative trim pieces are also commonly used in quality residential construction. For example, obliquely angled frieze boards 72 are provided immediately beneath the overhangs of roof 58. A horizontal frieze board 74 is often provided between the upper elevation of the first floor and the gable 60. Similarly, a horizontal frieze board 76 is often provided at the foundation or ground line 56. Corner trim pieces are often provided on full or simulated corner posts, as indicated at 78.

For all of these varieties of trim, one important advantage of the present invention is that the trim can be attached to the respective wall without penetrating or otherwise marring the exterior (visible) surface of the trim. Yet another advantage is providing an interface between the trim piece and siding panels without penetrating or otherwise marring the visible surface of the trim. Achieving these advantages is especially difficult and was not previously accomplished where at least one edge of the trim piece abuts a structure or condition which does not afford a surface for attaching the trim piece by means of a flange or the like. One example is the inner longitudinal edge of each pilaster 68, which closely confronts the side edges of door 62, which must be free to open and close.

Figure 5:
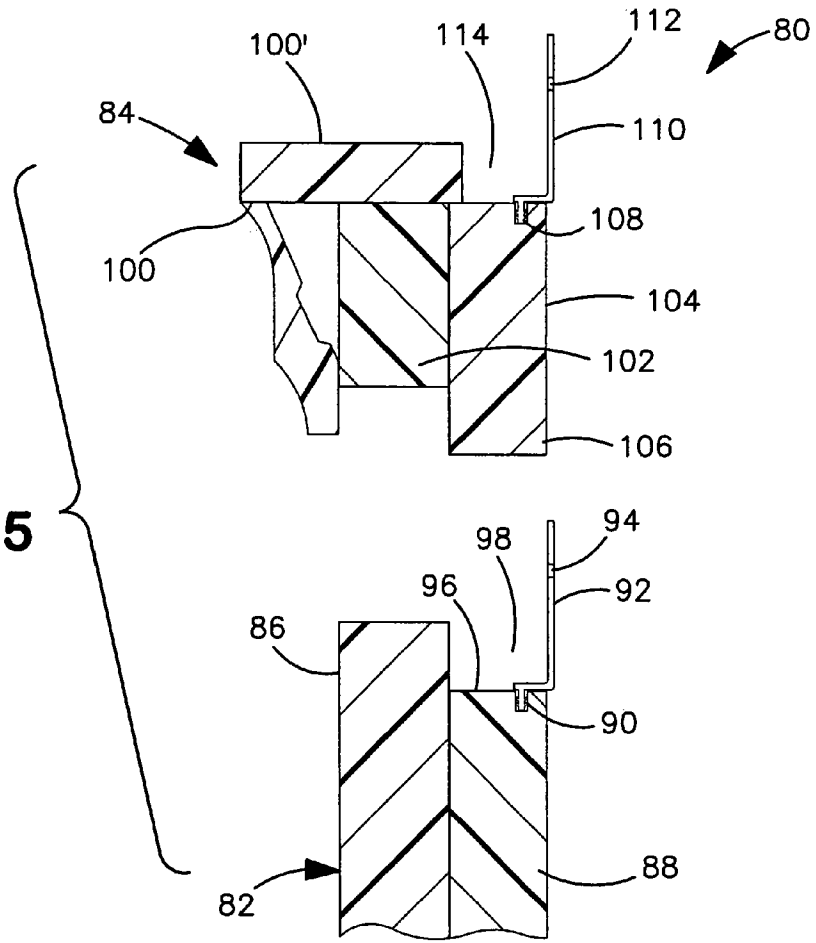
FIG. 5 is a schematic top view of a trim piece that has a mounting strip and siding channel at one edge.

FIG. 5 shows one example 80 of the top element 82 of a door adapted to receive a moulding unit 84. The top horizontal door element 86 is backed by an auxiliary element 88, which has a channel 90 for receiving a barbed or other portion of mounting strip 92 having a plurality of holes 94 by which the element 86 can be secured to a wall of a building. The top edge of member 88, along with the lower portion of the mounting strip 92, forms a channel 98. The bottom of the moulding piece 84 has a profile which mates with the upper profile of the upper portion of the door 82. The moulding comprises a front piece 100, an intermediate piece 102, and a back piece 104, with the downward projection of back piece 106 dimensioned to fit within the recess 98. A barbed or similar stem of another mounting strip fits in channel 108 with the mounting strip having holes 112 for attachment to the wall. A top portion 100' of the front piece 100 and the mounting strip 110 form another channel 114, which is sized to receive the edges of siding panels which, in the context of FIG. 5, would run longitudinally into or out of the plane of the drawing sheet.

It can be appreciated that when all of the components have been assembled according to FIG. 5, members 82 and 84 have been secured to the wall via the mounting strips 92, 110, respectively, but without penetration of the visible faces of the moulding. The mounting strip 92 and associated hardware passing through mounting holes 94 are covered by moulding 84 in the channel 98 and the mounting strip 110 and associated hardware in holes 112 are covered by wall siding in channel 114.

Figure 6:
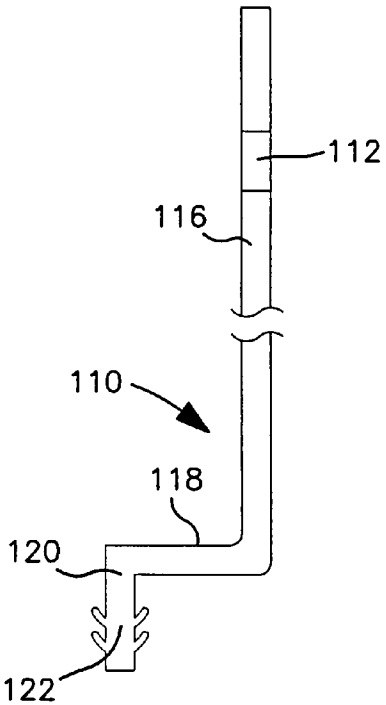
FIG. 6 is an end view of the mounting strip before insertion in a channel on the top edge of the trim piece of FIG. 5.

FIG. 6 depicts the preferred mounting strip 110 as shown in FIG. 5, which has an L-shaped body with vertical 116 and horizontal legs, and a stem 120 which extends downwardly from leg 118. The stem preferably has barbs which can relatively easily slip into the rectangular channel such as 108 in FIG. 5, but once installed present greater difficulty in removal from the channel.

In the other embodiments described herein, reference to a mounting strip with siding channel should be understood as meaning a configuration such as the siding strip 110 and channel 114 depicted in FIG. 5. Channel 114 is a primary channel for receiving siding panels whereas a groove or the like 108 into which the stem of the mounting strip 110 is engaged can be considered a secondary channel. Preferably, the primary channel has a width of approximately ¾ inch, whereas the secondary channel has a width of about ⅛ inch. Alternatively, the configuration shown in FIG. 2 where the secondary channel is recessed within the same edge as the secondary channel can be provided. Of course, the primary channel such as 114 can be oriented horizontally or vertically.

Figure 7:
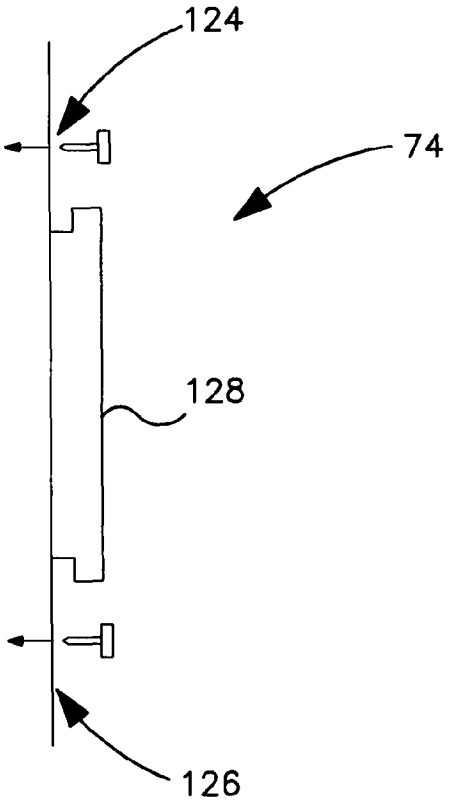
FIG. 7 is a schematic top view of a horizontal frieze board that has a mounting strip and siding channel at each of the opposite longitudinal edges.

FIG. 7 is a schematic side view of frieze board 74 depicted in FIG. 4, in which the horizontal top and horizontal bottom edges both carry a mounting strip and siding channel such as shown in 110 and 114 of FIG. 5. The frieze board would be attached to the wall via the upper and lower mounting strips and, once attached thereto, siding panels can be inserted along the longitudinal primary channels formed along the upper and lower edges. It can be appreciated that after the upper 124 and lower 126 mounting strips have been affixed to the wall and the siding panels inserted in the respective primary channels, the front face 128 presents a clean surface.

Figure 8:
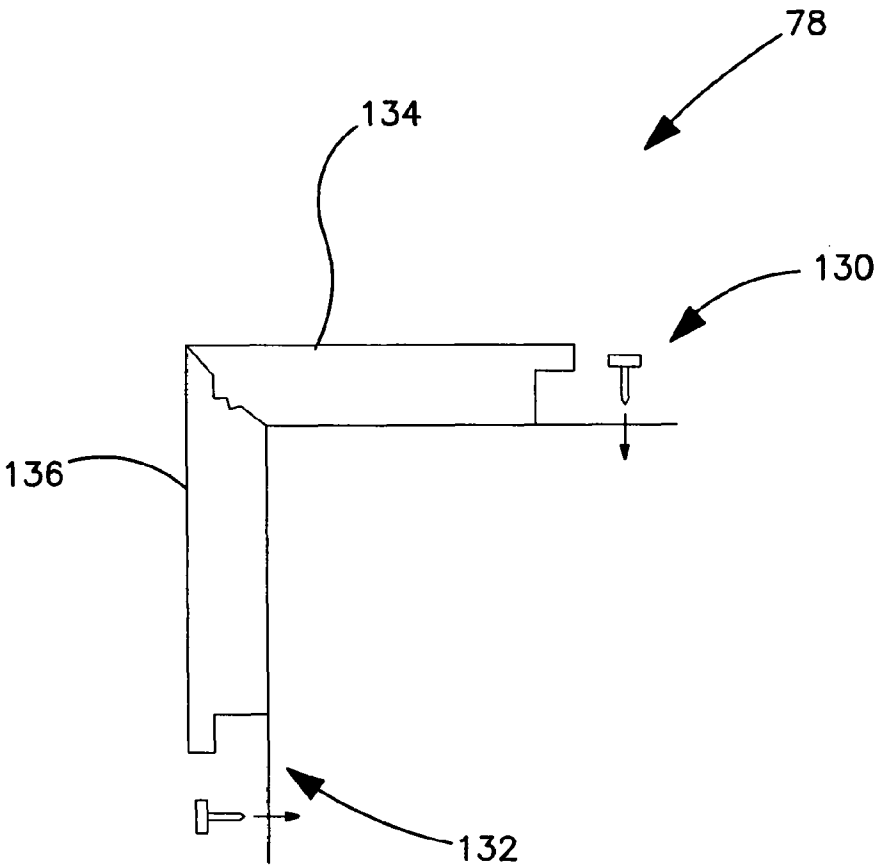
FIG. 8 is a schematic top view of a corner trim piece that has a mounting strip and siding channel at each of the opposite longitudinal edges.

FIG. 8 is a top view of a corner post such as 78 shown in FIG. 4. The corner post 78 depicted FIG. 8 is analogous to the frieze board 74, except that the outer edges are at right angles. Each has an associated mounting strip with primary channel 130, 132, such that when siding is inserted in the primary channels the front faces 134, 136 are cleanly presented.

FIG. 9 is a schematic representation of the frieze board 72, taken perpendicularly to the upper and lower edges, showing an embodiment in which a mounting strip and associated primary channel 138 are provided at the lower edge and a starter bracket 140 is provided at the other edge.

As further explained with respect to FIGS. 10-13, the starter bracket 140 is first attached to the building wall, before the body portion 142 of the frieze board is secured thereon. FIG. 10 shows the frieze board 140 as would be viewed from the left in FIG. 9, along the arrow 144. The starter bracket 140, standing alone, as shown in FIGS. 11 and 12, has a longitudinally extending, vertical back plate 152, a relatively short horizontal, forwardly extending leg or web 154 and a relatively short vertically extending front leg 156. Nail holes 146 are provided in the back plate 152 below the lower edge 158 of the short vertical leg 156. The lower edge is preferably mildly compressible, e.g., with a bend or the like which resembles a "J", when inserted into the longitudinal channel or groove 160 formed in the upper edge of the body 142 of the board. The starter bracket 140 is nailed to the wall with the upper horizontal leg 154 abutting the roofline 162. The frieze board is lifted vertically along plate 152 until the longitudinal groove 160 contacts the J-edge 158 and upon the application of additional upward force, the J-edge enters the groove and is compressed therein, thereby forming a tight friction fit, with the top of the board 142 flush against portion 154 of the bracket such that the overall top of the frieze board is flush with the overhang 162 of the roof line. The mounting strip and siding channel 138 at the lower edge of board 142 are still exposed for, first, nailing of the mounting flange to the wall and, secondly, the insertion of the siding panels into the associated primary channel.

With reference to FIG. 4, it can be appreciated that in the gable region 60, the siding panels would be nested one above the other, extending in a horizontal direction, with the lower edge of the lower most panel inserted in the longitudinal top edge of horizontal frieze board 74, and the left and right edges cut at an appropriate angle to lie flush with the primary channel on the left and right, obliquely oriented frieze boards 72.

Figure 14:
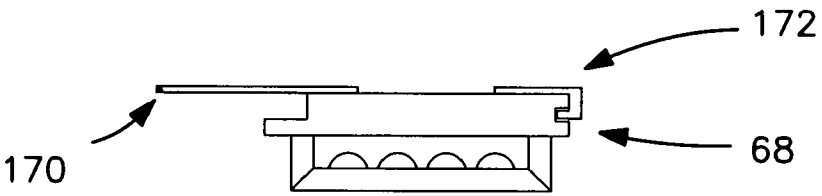
FIG. 14 is a top view of the door pilaster shown in FIG. 4.

FIG. 14 is a top view of the door pilaster 68 shown in FIG. 4, also with a combination of mounting strip and primary channel 170 on one vertical edge and starter bracket 172 along the other vertical edge. As in the case of starter bracket 140, the starter bracket 172 would be provided on the side or edge of the trim piece which is to abut another structure such as the door, where there is no surface for providing a mounting flange and, as with the embodiments of FIGS. 9-13, the starter bracket 172 is installed initially. The main body is slid into place to engage the J-edge of the starter bracket into the groove, thereby securing one side of the trim element to the wall, with the other side being secured through the mounting strip at 170, which strip in combination with a feature on the body of the trim piece provides a primary channel into which the edges of the siding panels are received and the ragged edges thereof hidden.

Figure 15:
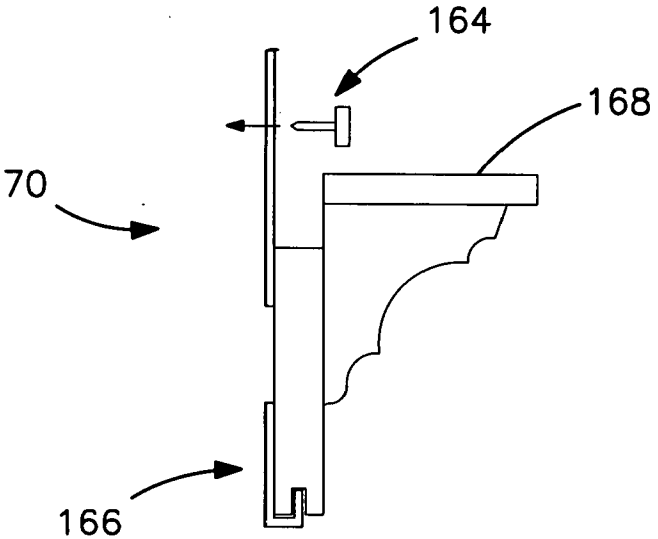
FIG. 15 is a side view of the door mantle shown in FIG. 4.

FIG. 15 is a side view of door mantle 70 (taken from the right side of FIG. 4) showing a combination of mounting strip with associated primary channel 164 and starter bracket 166 on the back side of moulding 168 in a manner analogous to that depicted with respect to moulding 84 in FIG. 5. However, in this embodiment the top element of the door need not have the mounting strip 92 and channel 98 shown in FIG. 5.

What is claimed:

1. A trim unit for attachment to a wall, comprising:

a trim body having front and back longitudinal faces and first and second longitudinal edges;

a longitudinal groove in said first edge;

a mounting bracket having a forward strip that is selectively friction fit into said groove, a back strip on the back face of the body, and a connecting web between the forward and back strips;

a mounting flange attached to and extending laterally from the body, beyond the second longitudinal edge; and a longitudinal channel, along said second edge, having a width that is effective to receive an edge of wall siding.

2. The trim unit of claim 1, wherein the front face has a lip portion at the second edge that extends laterally beyond the back face and the longitudinal channel is formed between said lip portion and a portion of said mounting flange.

3. The trim unit of claim 1, wherein the forward strip is removably engaged in the groove.

4. The trim unit of claim 1, wherein the forward strip has a "J" edge in the groove.

5. The trim unit of claim 1, wherein the back strip has holes for receiving hardware to affix the back strip to a wall before the front strip is inserted into the groove.

6. The trim unit of claim 1, wherein the front face has a lip portion at the second edge that extends laterally beyond the back face and the longitudinal channel is formed between said lip portion and a portion of said mounting flange;

the forward strip has a "J" edge that is removably compressed in the groove; and the back strip has holes for receiving hardware to affix the back strip to a wall before the front strip is inserted into the groove.

7. The trim unit of claim 1, wherein the web is substantially flush with the first edge when the forward strip is fully inserted in said groove.

8. A trim unit on a sided wall, comprising:

A body having front and back longitudinal faces and first and second longitudinal edges;

a mounting bracket attached to the wall behind the back face adjacent one edge of the body and secured to the body other than at the front face;

a mounting flange extending laterally from the body beyond the second edge and attached to the wall;

a channel along said second edge; and a plurality of wall siding panels connected together along horizontal edges and covering the mounting flange, wherein at least one panel has an edge within the channel.

9. The trim unit of claim 8, wherein the trim body is a door mantle.

10. The trim unit of claim 8, wherein the trim body is a door pilaster.

11. The trim unit of claim 8, wherein the trim body is a frieze board.

* * * * *